US005291767A

United States Patent [19]

Weindorf, Jr. et al.

[11] Patent Number: 5,291,767

[45] Date of Patent: Mar. 8, 1994

[54] PROTECTIVE LOCK CYLINDER MOUNTING ASSEMBLY

[75] Inventors: Charles T. Weindorf, Jr., Indianapolis; Gary A. Pelsue, Lapel, both of Ind.

[73] Assignee: Best Lock Corporation, Indianapolis, Ind.

[21] Appl. No.: 919,093

[22] Filed: Jul. 23, 1992

[51] Int. Cl.[5] ..... E05B 9/08

[52] U.S. Cl. ..... 70/370; 70/371; 70/381; 70/451; 70/DIG. 57

[58] Field of Search ..... 70/367-371, 70/DIG. 57, DIG. 60, 381, 451, 466

[56] References Cited

U.S. PATENT DOCUMENTS

| | | | |
|---|---|---|---|
| 409,246 | 8/1889 | Severance | 70/381 |
| 770,266 | 9/1904 | Crandall | 70/381 |
| 1,561,771 | 11/1925 | Best | 70/370 |
| 1,889,454 | 11/1932 | Shaw | 70/370 |
| 3,038,749 | 6/1962 | Check et al. | 70/451 |
| 3,307,384 | 3/1967 | Sinervo | 70/370 |
| 4,236,396 | 12/1980 | Surko, Jr. et al. | 70/451 X |
| 4,272,974 | 6/1981 | Hennessy | 70/370 X |
| 4,633,690 | 1/1987 | Foshée | 70/370 X |

FOREIGN PATENT DOCUMENTS

| | | | |
|---|---|---|---|
| 2723887 | 12/1978 | Fed. Rep. of Germany | 70/369 |
| 2200680 | 8/1988 | United Kingdom | 70/370 |

*Primary Examiner*—Lloyd A. Gall
*Attorney, Agent, or Firm*—Barnes & Thornburg

[57] ABSTRACT

A lock cylinder apparatus includes first and second lock cylinder assemblies rigidly fixed to a lock case and coupled to an internal locking mechanism contained in the lock case. The first lock cylinder assembly includes a lock body and an adaptor ring around the lock body. The adaptor ring is sized to fit into a cylinder assembly mounting hole in the lock case. A threaded member extends through the lock case and interconnects the second lock cylinder assembly to the adaptor ring of the first lock cylinder assembly. Illustratively, a hidden setscrew in the first lock cylinder assembly can be moved to engage the adaptor ring and anchor the lock body in a non-rotatable position in the adaptor ring.

22 Claims, 2 Drawing Sheets

PROTECTIVE LOCK CYLINDER MOUNTING ASSEMBLY

BACKGROUND AND SUMMARY OF THE INVENTION

This invention relates to locks, and particularly to apparatus for attaching a lock cylinder to a lock case. More particularly, this invention relates to an apparatus for mounting a lock body to a mortise lock case so that an interchangeable lock core in the lock body can be used to operate the mortise lock and for protecting the lock body and core from damage during an attack on the security of the lockset.

Lock cylinders are typically mounted in a lock case to prevent removal by unauthorized persons. It is known to use hidden setscrews to anchor a lock cylinder in a lock case as disclosed in U.S. Pat. No. 4,633,690 to Foshee. Advantageously, the security associated with such mortise locks is high because the hidden setscrews of the type disclosed in the Foshee '690 patent are only accessible to those persons authorized and able to remove the interchangeable FIG. 8 lock core from its home in the lock body to gain access to the hidden setscrews.

One problem with conventional mortise locks has been anchoring a lock cylinder that is different than the original equipment lock cylinder in the cylinder lock mounting hole provided in the mortise lock case. Many times, the owner of a mortise lock will decide to replace the lock cylinder that came with the mortise lock with a higher quality and higher security lock cylinder. For example, to increase the security of a mortise lockset, it would be desirable to replace a lock cylinder that is anchored to a lock case by means of an exposed setscrew with a higher security lock cylinder that is configured to be anchored to the same lock case by means of a hidden setscrew. The problem has been that, throughout the world and particularly outside the United States, conventional lock cylinders having hidden anchoring setscrews are not adapted to be mounted in many conventional mortise lock cases. Accordingly, a cylinder lock that could be retrofitted easily into a wide variety of lock cases and anchored in place in the lock case using hidden anchoring means would be a welcomed improvement.

According to the present invention, a lock cylinder apparatus is provided and configured to be mounted in a lock case having first and second exterior side walls arranged in spaced-apart parallel relation. The lock cylinder apparatus includes a first lock cylinder assembly mounted on the first exterior side wall of the lock case, a second lock cylinder assembly mounted on the second exterior side wall of the lock case, and means for coupling the first lock cylinder assembly to the second lock cylinder assembly to trap the lock case therebetween so that the first and second lock cylinders are rigidly fixed to the lock case and positioned to engage and operate an internal locking mechanism contained in the lock case.

The first lock cylinder assembly includes a first lock body formed to include a cavity for the reception of an interchangeable lock core and a first adaptor ring around the first lock body. The first adaptor ring includes an inner annular end wall engaging the first exterior side wall. The first adaptor ring is formed to include a central aperture receiving the first lock body therein and means for threadedly engaging the first lock body to fix the first lock body in the central aperture of the first adaptor ring. The coupling means includes a threaded member extending through the lock case and having a first end connected to the first adaptor ring and a second end connected to the second lock cylinder assembly.

In preferred embodiments, the first lock body includes an exterior side wall and is formed to include a bore extending between the cavity in the first lock body and the exterior side wall to define a hidden setscrew-receiving opening in the exterior side wall. The first adaptor ring includes an outer annular end wall facing away from the first exterior side wall of the lock case and surrounding the first lock body. The outer annular end wall is formed to include a radially outwardly extending channel. The first lock cylinder assembly further includes a hidden setscrew that is located in the bore and is movable therein to engage the radially outwardly extending channel formed in the first adaptor ring and anchor the first lock body in a non-rotatable mounted position to the first adaptor ring.

The first lock body includes an outer end away from the first adaptor ring and an annular lip on the outer end. The first lock cylinder assembly further includes a tubular cylinder ring surrounding the first lock body and having an inner end abutting the outer annular end wall of the first adaptor ring and an outer end lying in close proximity to the annular lip formed on the outer end of the first lock body. This tubular cylinder ring protects the lock from attack. Spring means is provided for yieldably urging the tubular cylinder ring toward the first adaptor ring to load the inner end of the tubular cylinder ring against the outer annular end wall of the first adaptor ring so that the tubular cylinder ring is restrained from movement relative to the first adaptor ring and the first lock body to minimize rattling. Illustratively, the spring means engages the annular lip and the outer end of the tubular cylinder ring.

The second lock cylinder assembly includes a second lock body formed to include a cavity for the reception of another interchangeable lock core and a second adaptor ring around the second lock body and the second end of the threaded member engages the second adaptor ring. Illustratively, the threaded member is arranged to interconnect the first and second adaptor rings.

The coupling means further includes a mounting pin appended to the inner annular end wall of the first adaptor ring and arranged to engage the second adaptor ring to set a minimum standoff spacing between the first and second adaptor rings to prevent deformation of the lock case during coupling of the first and second lock cylinders to one another using the coupling means. Illustratively, two mounting pins are used and arranged to lie on either side of the threaded members. In a preferred embodiment, the mounting pin is arranged to extend into a blind hole formed in the second adaptor ring. The first exterior side wall of the lock case is formed to include a notch and a border edge around the notch and the coupling means is situated to place the mounting pin in the notch and in engagement with the border edge around the notch to block rotation of the first lock cylinder about a longitudinal axis of the first lock cylinder and relative to the first exterior side wall of the lock case.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
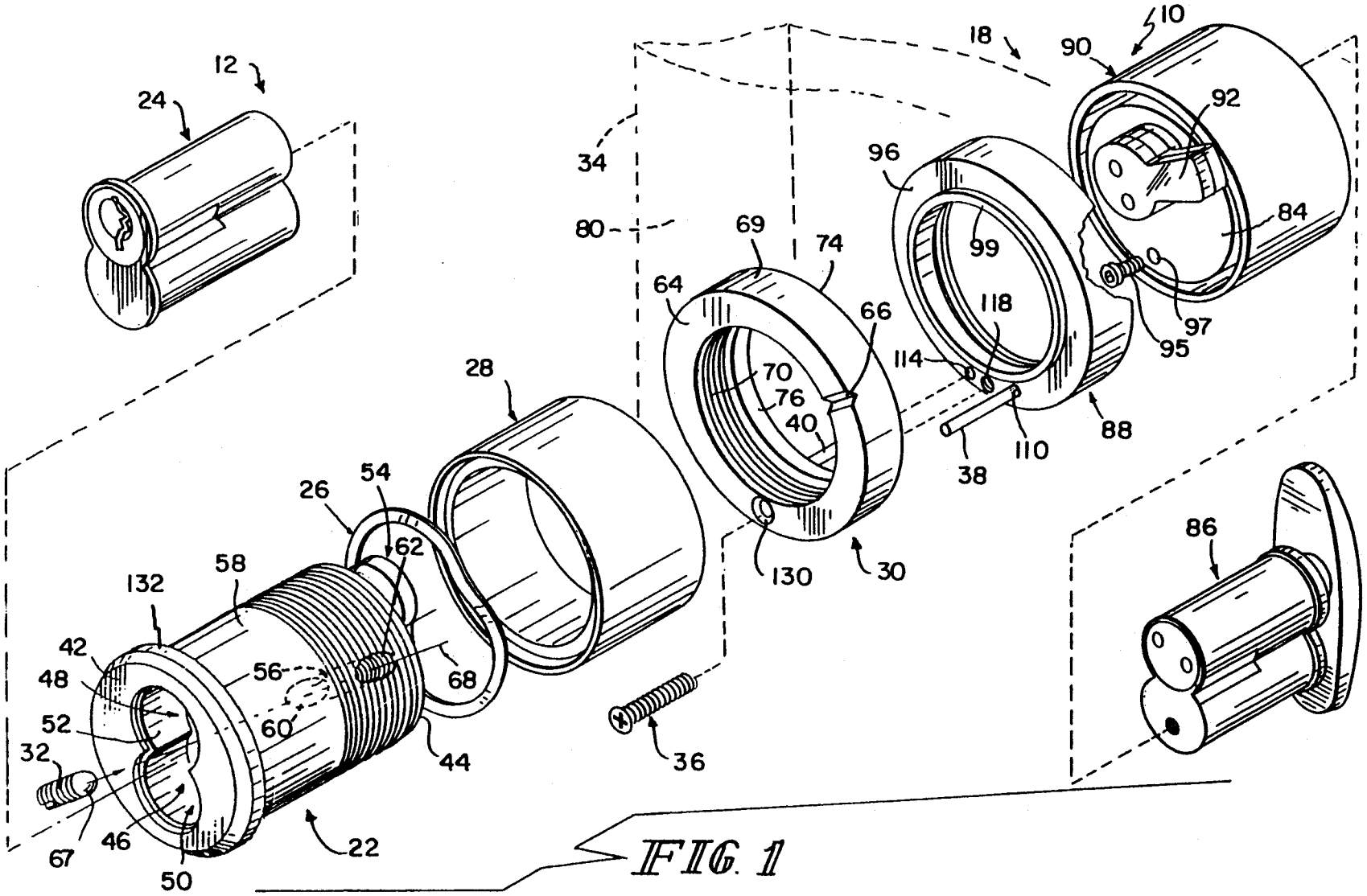
FIG. 1 is an exploded perspective view of a cylinder lock apparatus in accordance with the present invention showing a first lock cylinder assembly including an interchangeable lock core, a hidden setscrew, a first lock body, a spring, a cylinder ring, a first adaptor ring, a mortise lock case in phantom, and a second lock cylinder assembly including a second adaptor ring, a cylinder ring, and another interchangeable lock core.

A lock cylinder apparatus 10 in accordance with the present invention is shown in FIGS. 1–4. Apparatus 10 includes a first lock cylinder assembly 12 to be mounted in an aperture 15 in one side 14 of a door 16 and a second lock cylinder assembly 18 to be mounted in an aperture 17 in the other side 20 of the door 16 as shown best in FIG. 2.

Figure 2:
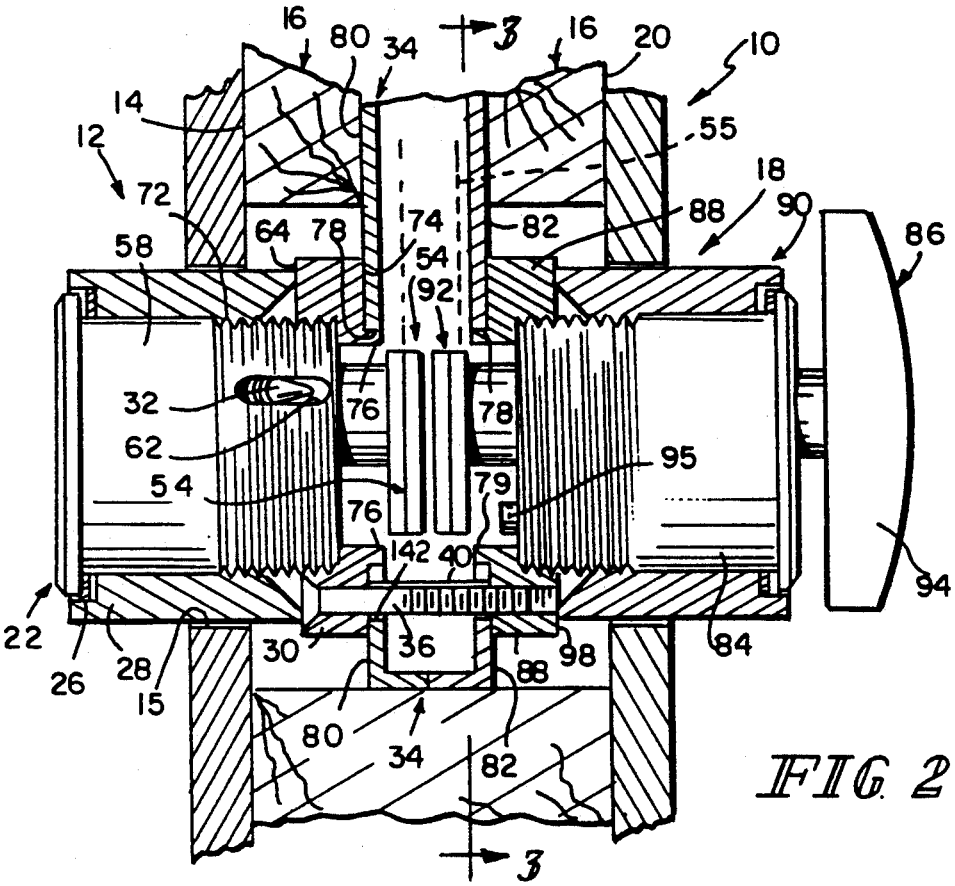
FIG. 2 is an assembled view of the apparatus shown in FIG. 1 in a mounted position on a hollow mortise lock case.
Figure 3:
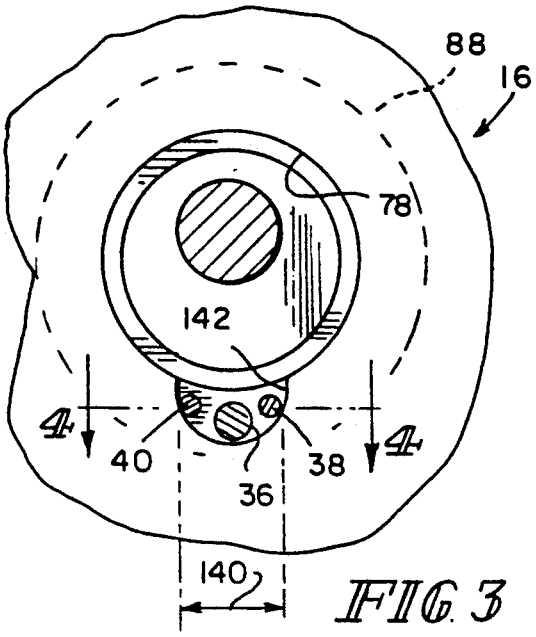
FIG. 3 is a view taken along lines 3—3 of FIG. 2 showing a pair of mounting pins arranged on either side of a threaded member to engage an edge bordering an offset notch to block rotation of the apparatus relative to the lock case.
Figure 4:
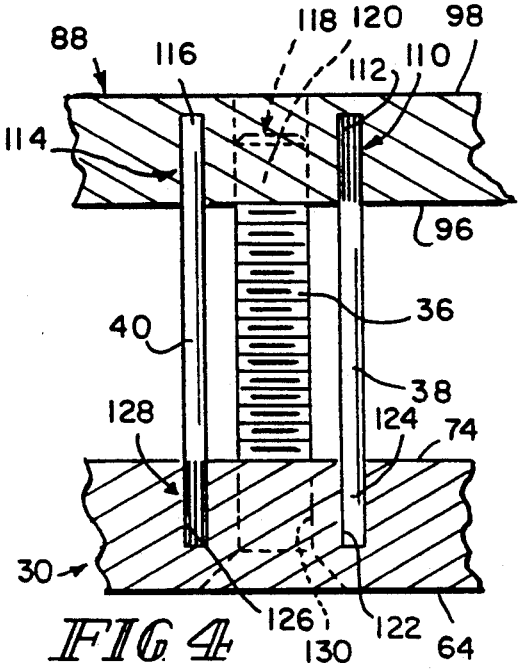
FIG. 4 is a view taken along lines 4—4 of FIG. 3 showing the use of the two mounting pins to provide standoffs separating the first and second adaptor rings.

As shown best in FIG. 1, the first lock cylinder assembly 12 includes a first lock body 22, an interchangeable lock core 24, a spring 26, a cylinder ring 28, and a first adaptor ring 30. The first lock body 22 is mountable to the first adaptor ring 30 by means of a cylinder-anchoring hidden setscrew 32. The first adaptor ring 30 abuts the lock case 34 and is coupled to the second lock cylinder assembly 18 using a threaded member 36 and a pair of mounting pins 38, 40 as shown in FIGS. 2–4.

The first lock body 22 includes a front face 42 and a rear face 44. The first lock body 22 is formed to include a cavity 46 for the reception of interchangeable lock core 24. Illustratively, cavity 46 is shaped to receive an interchangeable lock core of figure-8 cross-section, and, as such, includes an upper lobe chamber 48 and a lower lobe chamber 50. The upper lobe chamber 48 is defined in part by a contoured interior side wall 52. A cam assembly 54 is mounted on first lock body 22 and used to permit actuation of the remainder of the lock mechanism 55 mounted in lock case 34.

The first lock body 22 is formed to include a bore 56 extending between the lock body cavity 46 and an exterior side wall 58 of first lock body 22. The bore 56 has an inner opening 60 in the interior side wall 52 of the upper lobe chamber 48 and an outer opening 62 in the exterior side wall 58 as shown in FIG. 1. Conveniently, the bore 56 is tapped to receive the threaded hidden setscrew 32. An outer annular end wall 64 of first adaptor ring 30 is formed to include a radially outwardly extending shallow V-shaped groove or channel 66 for the reception of the tip 67 of hidden setscrew 32. The straight V-shaped channel 66 extends from the internal threads 70 defining the central lock body-receiving aperture formed in first adapter ring 30 to an annular radially outer side wall 69. Bore 56 has a longitudinal axis 68 as shown in FIG. 1. Reference is hereby made to U.S. Pat. No. 4,633,690 to Foshee for a description of a suitable hidden setscrew.

First adaptor ring 30 includes internal threads 70 for threadedly engaging external threads 72 on the first lock body 22. In use, the first lock body 22 is screwed onto the first adaptor ring 30 and the hidden setscrew 32 is moved to engage V-shaped slot 66 and thus used to anchor the first lock body 22 to the first adaptor ring 30. Once the lock core 24 is mounted in the cavity 48 formed in first lock body 22, it is impossible to remove the hidden setscrew 32.

First adaptor ring 30 also includes an inner annular end wall 74 having a circular raised rim 76 for centering the first adaptor ring 30 in a cylinder mounting hole 78 formed in a first exterior side wall 80 of the lock case 34. The cylinder mounting hole 78 also has an opening in a second exterior side wall 82 of the lock case 34 to receive the second lock cylinder assembly 18 as shown in FIG. 2.

The second lock cylinder assembly 18 includes a second lock body 84, an interchangeable lock core 86, and a second adaptor ring 88. The second lock body 84 is similar in size and construction to first lock body 22 and the second adaptor ring 88 is similar to the first adaptor ring 30. A second spring-loaded cylinder ring 90 (similar to the first cylinder ring 28) is mounted to surround the second lock cylinder body 84 and a cam assembly 92 is attached to second lock cylinder body 84 to control operation of the lock mechanism 55 contained in the lock case 34. In this case, an interchangeable lock core having a permanently attached thumbturn 94 is inserted into second lock cylinder body 84 and held in place by another hidden setscrew 95 passing through an aperture 97 formed in the second lock cylinder body 84, as shown in FIG. 1. It will be understood that it is within the scope of this invention to use any suitable interchangeable lock core in either lock cylinder body.

The second adaptor ring 88 includes an annular inner end wall 96 having a raised centering rim 99 (like rim 76) and an annular outer end wall 98 as shown in FIG. 2. As shown best in FIG. 4, the second adaptor ring 88 is formed to include a first blind hole 110 for receiving a distal end 112 of mounting pin 38 and a spaced-apart second blind hole 114 for receiving a distal end 116 of companion mounting pin 40. A threaded hole 118 is also formed in second adaptor ring 88 to receive the distal end 120 of the threaded member 36.

Also as shown in FIG. 4, the first adaptor ring 30 is formed to include a first blind hole 122 for receiving the proximal end 124 of mounting pin 38 and a second blind hole 126 for receiving the proximal end 128 of mounting pin 40. Mounting pin 38 is secured in place by means of a press-fit connection of end 112 in blind hole 110 and mounting pin 40 is secured in place by means of a press-fit connection of end 128 in blind hole 126. A threaded hole 130 is also formed in first adaptor ring 30 to receive the head end of the threaded member 36.

The threaded member 36 extends through the hollow space in lock case 34 to couple the first and second lock cylinder assemblies 12, 18 together by interconnecting the first and second adaptor rings 30, 88. Because apparatus 10 uses a threaded member 36 that mounts across the lock case 34 and is concealed by the cylinder ring 28, the adaptor ring mounting screw 36 is not exposed and vulnerable to attack. The head of threaded member 36 is not exposed when the door 16 is opened and is thus an improvement over conventional mortise lock designs.

The cylinder ring 28 surrounds the exterior side wall 58 of lock body 22 along its entire length. The cylinder ring 28 prevents twist-off of the lock body 22 by rotating freely about the lock body 22 when torque is applied to the cylinder ring 28. When assembled, the cylinder ring 28 is trapped axially between an annular rim 132 on lock body 22 and the outer annular end wall 64 on first adaptor ring 30 by spring 26 but is free to rotate. Second cylinder ring 90 is similar to first cylinder ring 28.

Illustratively, the adaptor rings 30, 88 can be made of steel, brass, or zinc. Lock bodies 22, 84 and cylinder rings 28, 90 can be made of brass or bronze or a variety of materials including, but not limited to, steel, zinc, aluminum, or plastic. Although the threaded member 36 is made of stainless steel, it could also be made of a high strength alloy steel. The mounting pins 38, 40 are made of hardened steel.

One feature of the invention is the use of hardened steel pins 38, 40 in adaptor rings 30, 88 to aid in installation and to strengthen the assembly 10. The pins 38, 40, as previously discussed, are mounted adjacent to the threaded mounting screw 36. As shown best in FIG. 3, resulting overall spread 140 of the pins 38, 40, when adaptor rings 30, 88 are mounted to the lock case, is slightly smaller than the cutout profile of the offset notch 142 formed in each side wall 80, 82 of lock case 34 and ensures proper rotational orientation of the adaptor rings 30, 88 to the lock case 34. Proper rotational orientation is critical to the cam 54, 92 operation of the lockset 10. Since the lock body 22 is located by the hidden setscrew 32 mating with the V-shaped slot 66 on the surface 64 of first adaptor ring 30 when lock body 22 is installed in first adaptor ring 30, the mounting pins 38, 40 ensure the necessary rotational orientation of lock body 22. The mounting pins 38, 40, 74 at a specified height, and mate in holes formed in the second adaptor ring 88 of a controlled depth or (in an embodiment not shown here) rest on surface 96 of the second adaptor ring 88. This arrangement prevents the lock case 34 from being deformed when mounting screw 36 is tightened during installation. The hardened pins 38, 40 also strengthen the assembly 10 by resisting bending when the lock body 22 is subject to impact, such as a hammer blow. Due to space constraints in the cutout profile of the lock case 34, the mounting screw 36 is of smaller diameter than desired. The hardened mounting pins, by mating with holes in the adaptor ring 88 opposite, essentially add cross-sectional area to that of mounting screw 36, increasing the force required to break the screw 36 and enhancing the security of the apparatus 10.

The mounting pins 38, 40 function in several different ways. Pins 38, 40 function as a standoff to separate the adjacent first and second adaptor rings 30, 88 (and the cams 54, 92) in a precise spaced-apart relation as shown in FIG. 2. Pins 38, 40 thereby act as standoffs to prevent collapse of the lock case 34 when the threaded member 36 is being tightened. Users will appreciate that such a standoff enhances the "feel" of the threaded member 36 during assembly as it will be apparent when threaded member 36 bottoms out and is sufficiently tightened. Also, the mounting pins 38, 40 engage the annular edge-bordering offset notch 142 as shown in FIG. 3 to prevent rotation of the first and second lock cylinders 12, 18 about their central axis and relative to the lock case 34. Also, the mounting pins 38, 40 serve to strengthen the threaded member 36 to resist breakage of the coupling between the first and second lock cylinders 12, 18 upon impact to one of the lock cylinders 12, 18 as during a hammer attack. It will be understood that one or more such mounting pins 38, 40 could be located around the circumference of the adaptor rings to function as described herein without obstructing assembling or operation of the lockset 10.

Although the invention has been described in detail with reference to certain preferred embodiments, variations and modifications exist within the scope and spirit of the invention as described and defined in the following claims.

We claim:

1. A lock cylinder apparatus mountable in a mortise lock case, the mortise lock case having first and second exterior side walls arranged in spaced-apart parallel relation, the first exterior side wall being formed to include a cylinder assembly mounting hole, the apparatus comprising a first lock cylinder assembly mounted on the first exterior side wall of the mortise lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein and means for threadedly engaging the first lock body to fix the first lock body in the central aperture of the first adaptor ring, the first adaptor ring being positioned on the first exterior side wall of the mortise lock case to lie around the cylinder assembly mounting hole, a second lock cylinder assembly mounted on the second exterior side wall of the mortise lock case, and means for coupling the first lock cylinder assembly to the second lock cylinder assembly to trap the mortise lock case therebetween so that the first and second lock cylinder assemblies are rigidly fixed to the mortise lock case and positioned to engage and operate an internal locking mechanism contained in the mortise lock case, the coupling means including a threaded member extending through the mortise lock case and having a first end connected to the first adaptor ring and a second end connected to the second lock cylinder assembly, the first exterior side wall is formed to include a notch lying outside the perimeter of the cylinder assembly mounting hole and opening into the cylinder assembly mounting hole and a border edge around the notch, the threaded member being positioned to lie in offset radially outwardly spaced apart relation to the perimeter of the cylinder assembly mounting hole formed in the first exterior side wall of the mortise lock case and in the notch adjacent to the border edge.

2. The apparatus of claim 1, wherein the second lock cylinder assembly includes a second lock body formed to include a cavity for the reception of an interchangeable lock core and a second adaptor ring around the second lock body and the second end of the threaded member engages the second adaptor ring.

3. The apparatus of claim 2, wherein the coupling means further includes a mounting pin appended to the inner annular end wall of the first adaptor ring and arranged to engage the second adaptor ring to set a fixed minimum standoff spacing between the first and second adaptor rings to prevent deformation of the mortise lock case during coupling of the first and second lock cylinder assemblies to one another using the coupling means.

4. The apparatus of claim 1, wherein the first lock cylinder assembly further includes a spin-free tubular cylinder ring surrounding the first lock body and having an inner end abutting the first adaptor ring and an outer end lying in spaced-apart relation to the first adaptor ring.

5. The apparatus of claim 4, wherein the first lock cylinder assembly further includes spring means for yieldably urging the tubular cylinder ring toward the first adaptor ring, the first lock body includes an annular lip, and the spring means surrounds the first lock body and engages the annular lip and the tubular cylinder ring.

6. The apparatus of claim 4, wherein the inner end of the tubular cylinder ring at least partially conceals the coupling means and reduces the vulnerability to attack of the coupling means.

7. A lock cylinder apparatus mountable in a lock case, the lock case having first and second exterior side walls arranged in spaced-apart parallel relation, the apparatus comprising a first lock cylinder assembly mounted on the first exterior side wall of the lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein and means for threadedly engaging the first lock body to fix the first lock body in the central aperture of the first adaptor ring, a second lock cylinder assembly mounted on the second exterior side wall of the lock case, and means for coupling the first lock cylinder assembly to the second lock cylinder assembly to trap the lock case therebetween so that the first and second lock cylinder assemblies are rigidly fixed to the lock case and positioned to engage and operate an internal locking mechanism contained in the lock case, the coupling means including a threaded member extending through the lock case and having a first end connected to the first adaptor ring and a second end connected to the second lock cylinder assembly, the first lock body including an exterior side wall and being formed to include a bore extending between the cavity in the first lock body and the exterior side wall to define a hidden setscrew-receiving opening in the exterior side wall, the first adaptor ring including an outer annular end wall facing away from the first exterior side wall of the lock case and surrounding the first lock body, the outer annular end wall being formed to include a radially outwardly extending channel, and the first lock cylinder assembly further including a hidden setscrew in the bore and being movable therein to engage the radially outwardly extending channel formed in the first adaptor ring and anchor the first lock body in a non-rotatable mounted position to the first adaptor ring.

8. The apparatus of claim 7, wherein the first lock body includes an outer end away from the first adaptor ring and an annular lip on the outer end, and the first lock cylinder assembly further includes a tubular cylinder ring surrounding the first lock body and having an inner end abutting the outer annular end wall of the first adaptor ring and an outer end lying in close proximity to the annular lip formed on the outer end of the first lock body and spring means for yieldably urging the tubular cylinder ring toward the first adaptor ring to load the inner end of the tubular cylinder ring against the outer annular end wall of the first adaptor ring so that the tubular cylinder ring is restrained from movement relative to the first adaptor ring and the first lock body to minimize rattling, the spring means engaging the annular lip and the outer end of the tubular cylinder ring.

9. The apparatus of claim 7, wherein the first adaptor ring is formed to include a first screw-receiving passageway extending between the outer and inner annular end walls and lying in spaced-apart relation to the radially outwardly extending channel, the second lock cylinder assembly is formed to include a second screw-receiving passageway coaxially aligned with the first screw-receiving passageway and the threaded member extends into the first and second screw-receiving passageways and draws the first and second lock cylinder assemblies toward one another to trap the lock case therebetween.

10. The apparatus of claim 9, wherein the coupling means further includes a mounting pin appended to the inner annular end wall of the first adaptor ring and is arranged to extend into a blind hole formed in the second lock cylinder assembly and located in spaced relation to the second screw-receiving passageway.

11. A lock cylinder apparatus mountable in a mortise lock case, the mortise lock case having first and second exterior side walls arranged in spaced-apart parallel relation, the first exterior side wall being formed to include a cylinder assembly mounting hole, the apparatus comprising a first lock cylinder assembly mounted on the first exterior side wall of the mortise lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein and means for threadedly engaging the first lock body to fix the first lock body in the central aperture of the first adaptor ring, the first adaptor ring being positioned on the first exterior side wall of the mortise lock case to lie around the cylinder assembly mounting hole, a second lock cylinder assembly mounted on the second exterior side wall of the mortise lock case, the second lock cylinder having a second lock body formed to include a cavity for the reception at an interchangeable lock core and a second adaptor ring around the second lock body, the second end of the threaded member engaging the second adaptor ring, and means for coupling the first lock cylinder assembly to the second lock cylinder assembly to trap the mortise lock case therebetween so that the first and second lock cylinder assemblies are rigidly fixed to the mortise lock case and positioned to engage and operate an internal locking mechanism contained in the mortise lock case, the coupling means including a threaded member extending through the mortise lock case and having a first end connected to the first adaptor ring and a second end connected to the second lock cylinder assembly, the threaded member being positioned to lie in offset radially outwardly spaced-apart relation to the perimeter of the cylinder assembly mounting hole formed in the first exterior side wall of the mortise lock case, the coupling means further including a mounting pin appended to the inner annular end wall of the first adaptor ring and arranged to extend into an unthreaded blind hole formed in the second adaptor ring.

12. A lock cylinder apparatus mountable in a lock case, the lock case having first and second exterior side walls arranged in spaced-apart parallel relation, the apparatus comprising a first lock cylinder assembly mounted on the first exterior side wall of the lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein and means for threadedly engaging the first lock body to fix the first lock body in the central aperture of the first adaptor ring, a second lock cylinder assembly mounted on the second exterior side wall of the lock case, the second lock cylinder assembly including a second lock body formed to include a cavity for the reception of an interchangeable lock core and a second adaptor ring around the second lock body, and means for coupling the first lock cylinder assembly to the second lock cylinder assembly to trap the lock case therebetween so that the first and second lock cylinder assemblies are rigidly fixed to the lock case and positioned to engage and operate an internal locking mechanism contained in the lock case, the coupling means including a threaded member extending through the lock case and having a first end connected t the first adaptor ring and a second end connected to the second lock cylinder assembly, the second end of the threaded member engaging the second adaptor ring, the coupling means further including a mounting pin appended to the inner annular end wall of the first adaptor ring and arranged to extend into a blind hold formed in the second adaptor ring, the first exterior side wall being formed to include a notch and a border edge around the notch, and the coupling means being situated to place the mounting pin in the notch and in engagement with the border edge around the notch to block rotation of the first lock cylinder assembly about a longitudinal axis of the first lock cylinder assembly and relative to the first exterior side wall of the lock case.

13. A lock cylinder apparatus mountable in a mortise lock case, the mortise lock case having first and second exterior side walls arranged in spaced-apart parallel relation, the first exterior side wall being formed to include a cylinder assembly mounting hole, the apparatus comprising a first lock cylinder assembly mounted on the first exterior side wall of the mortise lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein, and means for threadedly engaging the first lock body to fix the first lock body in the central aperture of the first adaptor ring, the first adaptor ring being positioned on the first exterior side wall of the mortise lock case to lie around the cylinder assembly mounting hole, the first adaptor ring further including an axially inwardly extending circular rim appended to the inner annular end wall and being configured to extend into the cylinder assembly mounting hole in close fitting relation to the first exterior side wall to center the first adaptor ring in the cylinder assembly mounting hole, a second lock cylinder assembly mounted on the second exterior side wall of the mortise lock case, and means for coupling the first lock cylinder assembly to the second lock cylinder assembly to trap the mortise lock case therebetween so that the first and second lock cylinder assemblies are rigidly fixed to the mortise lock case and positioned to engage and operate an internal locking mechanism contained in the mortise lock case, the coupling means including a threaded member extending through the mortise lock case and having a first end connected to the first adaptor ring and a second end connected to the second lock cylinder assembly, the threaded member being positioned to lie in offset radially outwardly spaced-apart relation to the perimeter of the cylinder assembly mounting hole formed in the first exterior side wall of the mortise lock case.

14. A lock cylinder apparatus mountable in a lock case, the lock case having first and second exterior side walls arranged in spaced-apart parallel relation, the apparatus comprising a first lock cylinder assembly mounted on the first exterior side wall of the lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein and means for threadedly engaging the first lock body to fix the first lock body in the central aperture of the first adaptor ring, a second lock cylinder assembly mounted on the second exterior side wall of the lock case, and means for coupling the first lock cylinder assembly to the second lock cylinder assembly to trap the lock case therebetween so that the first and second lock cylinder assemblies are rigidly fixed to the lock case and positioned to engage and operate an internal locking mechanism contained in the lock case, the coupling means including s threaded member extending through the lock case and having a first end connected to the first adaptor ring and a second end connected to the second lock cylinder assembly, the first exterior side wall being formed to include a cylinder mounting hole and the first adaptor ring including an axially inwardly extending circular rim appended to the inner annular end wall and configured to extend into the cylinder mounting hole in close fitting relation to the first exterior side wall to center the first adaptor ring and the first lock body in the cylinder mounting hole, the first exterior side wall being also formed to include an offset notch opening into the cylinder mounting hole and the coupling means including a mounting pin appended to the inner annular end wall of the first adaptor ring and arranged to pass through the offset notch to reach and engage the second lock cylinder assembly to define a standoff in the lock case between the first and second lock cylinder assemblies.

15. The apparatus of claim 14, wherein the first exterior side wall includes an edge bordering the offset notch and the mounting pin is positioned to engage the edge to block relative movement between the first adaptor ring and the first exterior side wall.

16. The apparatus of claim 14, wherein the second lock cylinder assembly is formed to include a blind hole and the mounting pin includes a distal end extending into the blind hole.

17. A lock cylinder apparatus mountable in a mortise lock case, the mortise lock case having first and second exterior side walls arranged in spaced-apart parallel relation, the apparatus comprising a first lock cylinder assembly mounted on the first exterior side wall of the mortise lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein and means for threadedly engaging the first lock body to fix the first lock body in the central aperture of the first adaptor ring, a second lock cylinder assembly mounted on the second exterior side wall or the mortise lock case, and means for coupling the first lock cylinder assembly to the second lock cylinder assembly to trap the mortise lock case therebetween so that the first and second lock cylinder assemblies are rigidly fixed to the mortise lock case and positioned to engage and operate an internal locking mechanism contained in the mortise lock case, the coupling means including a threaded member extending through the mortise lock case and having a first end connected to the first adaptor ring and a second end connected to the second lock cylinder assembly, the second lock cylinder assembly including a second lock body formed to include a cavity for the reception of an interchangeable lock core and a second adaptor ring around the second lock body and the second end of the threaded member terminating in the second adaptor ring, the first exterior side wall being formed to include a cylinder mounting hole, a notch lying outside the perimeter of the cylinder assembly mounting hole and opening into the cylinder assembly mounting hole, and a border edge around the notch, the coupling means further including a mounting pin appended to the inner annular end wall and arranged to lie in spaced-apart relation to the threaded member, the mounting pin being positioned to engage the border edge around the notch to block relative movement between the first adaptor ring and the first exterior side wall.

18. The apparatus of claim 17, wherein the second end of the threaded member engages the second adaptor ring and the mounting pin includes a distal end engaging the second adaptor ring.

19. The apparatus of claim 18, wherein the second adaptor ring is formed to include a blind hole and the distal end of the mounting pin is positioned to extend into the blind hole.

20. A lock cylinder apparatus mountable in a lock case, the lock case having first and second exterior side walls arranged in spaced-apart parallel relation, the apparatus comprising a first lock cylinder assembly mounted on the first exterior side wall of the lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein and means for threadedly engaging the first lock body to fix the first lock body in the central aperture of the first adaptor ring, a second lock cylinder assembly mounted on the second exterior side wall of the lock case, and means for coupling the first lock cylinder assembly to the second lock cylinder assembly to trap the lock case therebetween so that the first and second lock cylinder assemblies are rigidly fixed to the lock case and positioned to engage and operate an internal locking mechanism contained in the lock case, the coupling means including a threaded member extending through the lock case and having a first end connected to the first adaptor ring and a second end connected to the second lock cylinder assembly, the second lock cylinder assembly including a second lock body formed to include a cavity for the reception of an interchangeable lock core and a second adaptor ring around the second lock body, the second end of the threaded member engaging the second adaptor ring, the second lock cylinder assembly including a threaded setscrew and the second lock body being formed to include an aperture for receiving the threaded setscrew, the lock core being formed to include a threaded aperture aligned with the aperture in the second lock body and sized to receive the threaded setscrew, the threaded setscrew and apertures being concealed when the first lock cylinder assembly is coupled to the second lock cylinder assembly.

21. A lock cylinder apparatus mountable in a mortise lock case, the mortise lock case having first and second exterior side walls arranged in spaced-apart parallel relation, the first exterior side wall being formed to include a cylinder assembly mounting hole, the apparatus comprising a first lock cylinder assembly mounted on the first exterior side wall of the mortise lock case, the first lock cylinder assembly including a first lock body formed to include a cavity for the reception of an interchangeable lock core and a first adaptor ring around the first lock body, the first adaptor ring including an inner annular end wall engaging the first exterior side wall and being formed to include a central aperture receiving the first lock body therein and means for threadedly engaging the first lock body to fix the first lock body in the central aperture of the first adaptor ring, the first adaptor ring being positioned on the first exterior side wall of the mortise lock case to lie around the cylinder assembly mounting hole, a second lock cylinder assembly mounted on the second exterior side wall of the mortise lock case, and means for coupling the first lock cylinder assembly to the second lock cylinder assembly to trap the mortise lock case therebetween so that the first and second lock cylinder assemblies are rigidly fixed to the mortise lock case and positioned to engage and operate an internal locking mechanism contained in the mortise lock case, the coupling means including a threaded member extending through the mortise lock case and having a first end connected to the first adaptor ring and a second end connected to the second lock cylinder assembly, the threaded member being positioned to lie in offset radially outwardly spaced-apart relation to the perimeter of the cylinder assembly mounting hole formed in the first exterior side wall of the mortise lock case, the first exterior side wall being formed to include a notch lying outside the perimeter of the cylinder assembly mounting hole and opening into the cylinder assembly mounting hole and a border edge around the notch, and the coupling means further including a first mounting pin positioned to lie alongside the threaded member and in engagement with the border edge around the notch to block rotation of the first lock cylinder assembly about a longitudinal axis of the first lock cylinder assembly and relative to the first exterior side wall of the mortise lock case.

22. The apparatus of claim 21, wherein the coupling means further includes a second mounting pin positioned to lie in spaced-apart location to the first mounting pin to locate the threaded member therebetween and in engagement with the border edge around the notch to block rotation of the first lock cylinder assembly about a longitudinal axis of the first lock cylinder assembly and relative to the first exterior side wall of the mortise lock case.

* * * * *